US008322541B2

(12) United States Patent
Maclaren-Taylor

(10) Patent No.: US 8,322,541 B2
(45) Date of Patent: Dec. 4, 2012

(54) TOWEL RAIL WITH ELECTRIC HEATING ELEMENT

(76) Inventor: Andrew Keith Maclaren-Taylor, Hyde Park (ZA)

( * ) Notice: Subject to any disclaimer, the term of this patent is extended or adjusted under 35 U.S.C. 154(b) by 916 days.

(21) Appl. No.: 12/302,165

(22) PCT Filed: May 23, 2007

(86) PCT No.: PCT/ZA2007/000029

§ 371 (c)(1),
(2), (4) Date: Nov. 24, 2008

(87) PCT Pub. No.: WO2007/137305

PCT Pub. Date: Nov. 29, 2007

(65) Prior Publication Data

US 2009/0266774 A1 Oct. 29, 2009

(30) Foreign Application Priority Data

May 24, 2006 (ZA) ..... 2006/04225

(51) Int. Cl.

| | |
|---|---|
| ***A47K 10/06*** | (2006.01) |
| ***H05B 3/06*** | (2006.01) |
| ***F26B 19/00*** | (2006.01) |
| ***F26B 9/10*** | (2006.01) |

(52) U.S. Cl. ..... 211/16; 211/123; 219/201; 219/385; 219/520; 219/532; 34/90; 34/106; 34/240

(58) Field of Classification Search ..... 211/6, 16, 211/88.04, 204, 206, 87.01, 182; 219/201, 219/385, 520, 402, 407, 532, 534, 536, 538; 34/104, 239, 240, 385, 90, 106
See application file for complete search history.

(56) References Cited

U.S. PATENT DOCUMENTS

| | | | | |
|---|---|---|---|---|
| 1,666,063 | A * | 4/1928 | Aubrey | 211/16 |
| 1,677,280 | A * | 7/1928 | Gilbert | 219/473 |
| 2,494,861 | A * | 1/1950 | Chapman | 219/524 |
| 2,567,434 | A * | 9/1951 | Hoskings | 219/520 |
| 2,571,918 | A * | 10/1951 | Meninger | 219/553 |

(Continued)

FOREIGN PATENT DOCUMENTS

| | | |
|---|---|---|
| EP | 0921368 | 6/1999 |

(Continued)

OTHER PUBLICATIONS

International search report in corresponding PCT/ZA2007/000029.

*Primary Examiner* — Darnell Jayne
*Assistant Examiner* — Joshua Rodden
(74) *Attorney, Agent, or Firm* — Young & Thompson

(57) ABSTRACT

A method of assembling a towel rail having vertically extending, elongate, tubular supports opposed and spaced apart from each other, and spaced apart, horizontally extending, tubular beams, the method including: a) threading an elongate flexible heating element through a respective support; b) looping an appropriate length of the element through each hole of the support to form a plurality of looped sections; c) threading each looped section through a respective beam from the second end; d) inserting the second end of each beam through a respective hole of the respective support to bring an abutment surface of the second end into contact with an inner surface of the support; and e) locking the second end of each beam to the support by passing a fastener at least partially through the support to engage with a recess formed in the second end.

20 Claims, 8 Drawing Sheets

U.S. PATENT DOCUMENTS

| | | | | | |
|---|---|---|---|---|---|
| 2,756,318 | A | * | 7/1956 | Konrad et al. | 219/201 |
| 2,756,720 | A | * | 7/1956 | Richmond et al. | 119/468 |
| 3,160,734 | A | * | 12/1964 | Rylander | 219/201 |
| 3,217,137 | A | * | 11/1965 | Weitzner | 219/201 |
| 3,457,389 | A | * | 7/1969 | Knapp | 219/448.18 |
| RE32,616 | E | * | 3/1988 | Graham | 219/385 |
| D324,620 | S | * | 3/1992 | Chalot | D6/548 |
| 5,190,305 | A | * | 3/1993 | Putman | 280/79.3 |
| 5,320,030 | A | * | 6/1994 | Hubbard | 99/423 |
| 5,566,838 | A | * | 10/1996 | Tseng | 211/37 |
| 5,642,462 | A | * | 6/1997 | Huff | 392/382 |
| 6,153,862 | A | * | 11/2000 | Job | 219/521 |
| D466,744 | S | * | 12/2002 | Lowe | D6/550 |
| 6,918,193 | B2 | * | 7/2005 | Marolt | 34/104 |
| 6,935,279 | B2 | * | 8/2005 | Bosworth | 122/4 R |
| 7,723,646 | B2 | * | 5/2010 | Lam | 219/217 |
| 2009/0188879 | A1 | * | 7/2009 | Shieh | 211/88.04 |

FOREIGN PATENT DOCUMENTS

| | | |
|---|---|---|
| FR | 2695466 | 3/1994 |
| GB | 2212037 | 7/1989 |
| GB | 2365114 | 2/2002 |

* cited by examiner

TOWEL RAIL WITH ELECTRIC HEATING ELEMENT

BACKGROUND OF THE INVENTION

This invention relates to a towel rail such as a heated towel rail which is manufactured from stainless steel tubes as well as a method of manufacturing thereof.

It is known to manufacture heated towel rails from a plurality of horizontal beams which are welded to one or more vertical posts. It is difficult, cumbersome and expensive to obtain a neat weld between the respective beams and each support.

As towel rails often fulfill both practical and aesthetic functions it is important that the finished product is neatly finished with clean lines and junctions.

SUMMARY OF THE INVENTION

The invention aims to provide an alternative towel rail and a method of manufacturing thereof.

The invention provides a towel rail which includes at least one vertically extending, elongate, tubular support, a plurality of spaced apart, horizontally extending, tubular beams which extend from the support, each of which has a first end and an opposing second end, a first recess formed in the first end and a second recess formed in the second end and a plurality of fasteners, each of which extends at least partially through the support and which is engaged with a recess.

Preferably the towel rail includes two opposing and spaced apart supports.

The support and beams may be circular in cross-section, or may be rectangular in cross-section. The support and beams may be made from metal and is preferably made from stainless steel.

Each of the first and second ends may include an abutment surface which abuts against a support. The abutment surface may be semicircular and complementary in shape to the support. Alternatively the abutment surface may include two spaced apart abutment points.

Each of the first and second ends may include a shoulder formation.

Each of the first and second ends may include a spacer which extends from the respective beam.

Each beam may include a first opening in the first end which faces in a first direction. The first opening may include a catch formation. Each beam may include a second opening in the second end which faces in a second direction which is opposed to the first direction. Each of the first and second openings may be in the form of a slot.

Each fastener may be in the form of a grub screw or a bolt.

The towel rail may include a plurality of apertures in the support through which the fasteners extend.

The towel rail may include an attachment bracket which is engaged with the support and which is used to fix the support to fixed structure.

The towel rail may include a connection means between the attachment bracket and the support.

The connection means may include a tubular arm which is fixed to the bracket and a flange formation which extends from the support. The connection means may include a hook formation on the arm and a recessed catch formation in the support with which the hook formation is interengageable. The flange is preferably integrally formed with the support. The connection means may include a securing member which interconnects the arm and the flange formation.

The towel rail may include a passage which extends from the support, through the connection means to the bracket.

The towel rail may include an elongate heating element which extends at least partially through the support and the beams.

The invention also provides a method of manufacturing a towel rail which includes the steps of:

(a) cutting a plurality of holes in an elongate, tubular metallic support;

(b) forming a first recess in a first end of an elongate, tubular, metallic beam and forming a second recess in a second opposing end of the beam;

(c) engaging a plurality of beams with the support by engaging the first end of each beam with a respective hole; and (d) fixing the support and each beam to one another by passing a fastener through the support and engaging the fastener with the first recess.

The method may include the step of forming an aperture in the support where through the fastener can extend.

The method may include the step of cutting a first opening in the first end which faces a first direction. The method may include the step of cutting a second opening in the second end which faces a second direction which is opposite to the first direction.

The method may include the step of shaping the first and second ends to be complementary with an inner side of the support. Each of the first and second ends may be shaped to be semicircular.

Alternatively the method may include the step of forming two, spaced apart abutment points on each of the first and second ends.

The method may include the step of forming a shoulder formation on each of the first and second ends.

The method may include the step of cutting a spacer formation from each of the first and second ends in order for the spacer formation to remain integral with the beam.

The method may include the step of threading an elongate, flexible heating element at least partially through the support and beams.

The method may include the step of fixing a bracket to the support.

The method may include the step of cutting a flange from the support which extends from the support and is integrally formed with the support.

The method may include the step of fixing an arm which extends from the bracket to the flange.

The method may include the step of interengaging a hook formation which is formed on the arm with a catch formation in the support.

The invention further provides a towel rail which has at least one vertically extending, elongate, tubular support, a plurality of horizontally extending, elongate, tubular beams which extend from the support, at least one attachment bracket which is fixed to the support and a connection means between the bracket and the support which has a tubular arm which is connected to the bracket, a flange formation which extends from and is integrally formed with the support and a securing member which interconnects the arm and the flange.

The connection means may include a hook formation on the arm and a recessed catch formation in the support which hook formation and catch formation are interengaged.

The towel rail may include a passage which extends from the support, through the connection means and to the bracket.

The towel rail may include an elongate, flexible heating element which extends through the passage.

The invention also extends to a method of fixing a bracket to a towel rail which has a vertically extending, elongate, tubular support which includes the steps of:

(a) cutting a flange formation in the support;

(b) bending the flange formation away from the support in order for the flange formation to extend away from the support while remaining integral with the support;

(c) cutting a catch formation in the support; and (d) interconnecting a tubular arm which extends from the bracket with the flange formation and interengaging a hook formation on the arm with the catch formation.

The cutting of the flange formation and the catch formation in the support may take place simultaneously.

The method may include the step of fixing a securing member to the arm and the flange formation.

BRIEF DESCRIPTION OF THE DRAWINGS

The invention is further described by way of examples with reference to the accompanying drawings in which.

DESCRIPTION OF PREFERRED EMBODIMENTS

Figure 1:
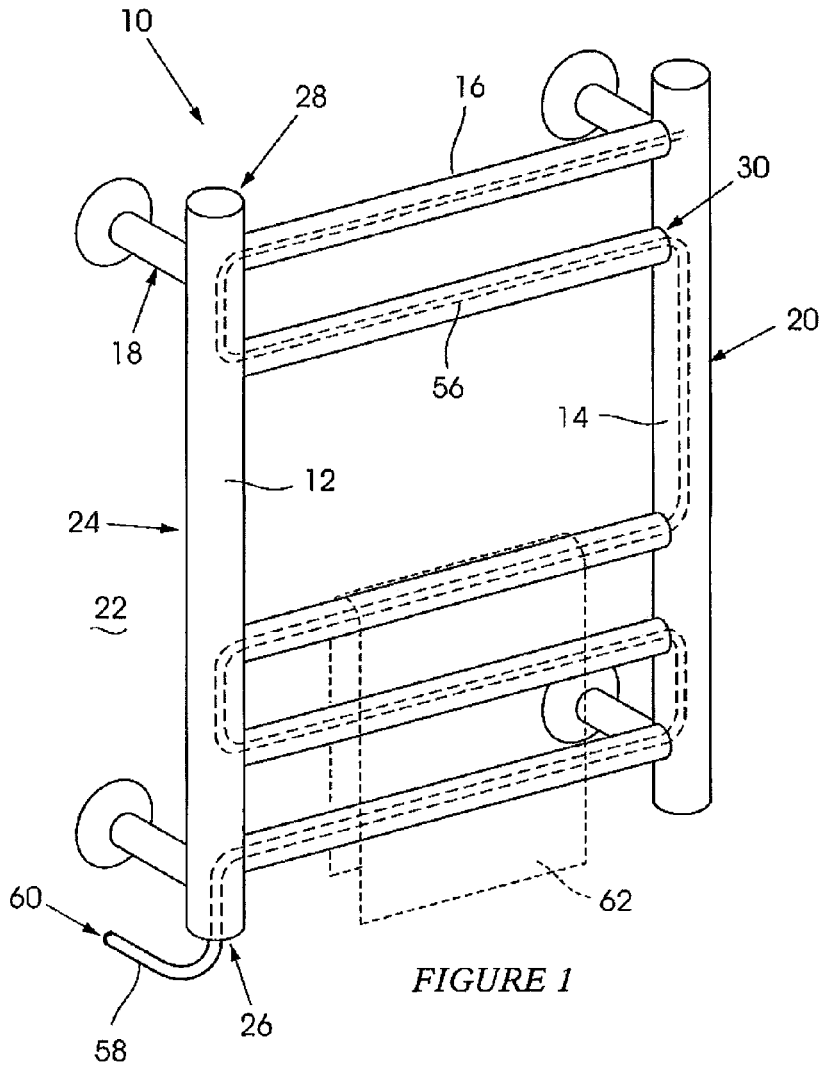
FIG. 1 is a perspective view of a towel rail according to the invention.
Figure 2:
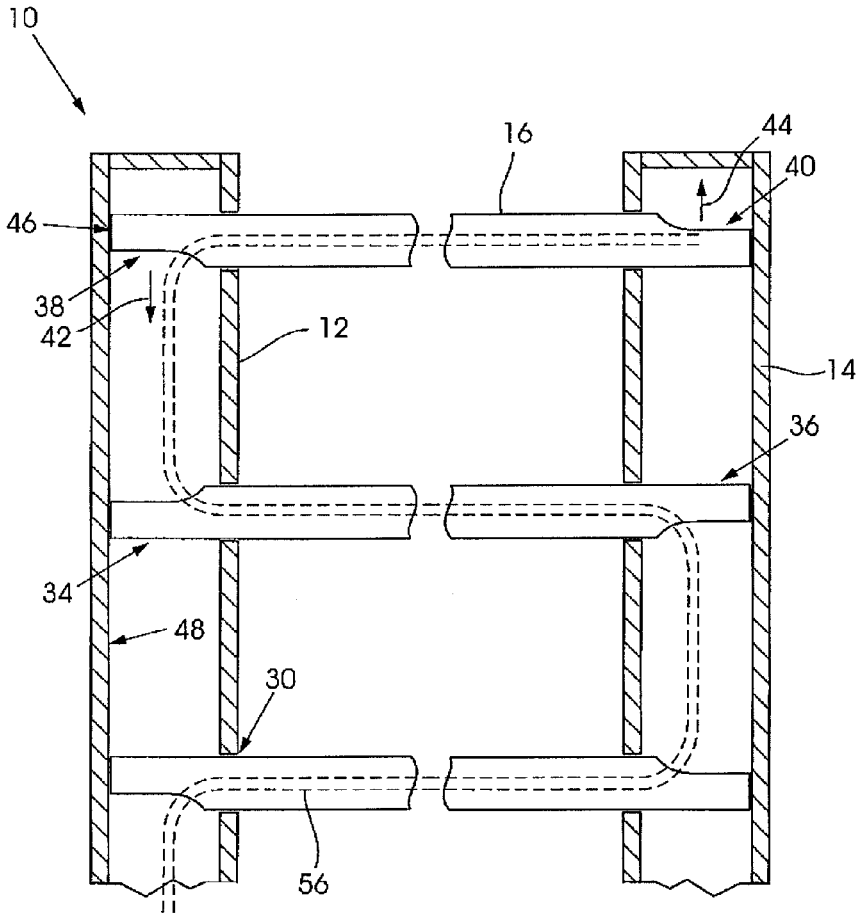
FIG. 2 is a partial, cross-sectioned side view of the towel rail of FIG. 1.
Figure 3:
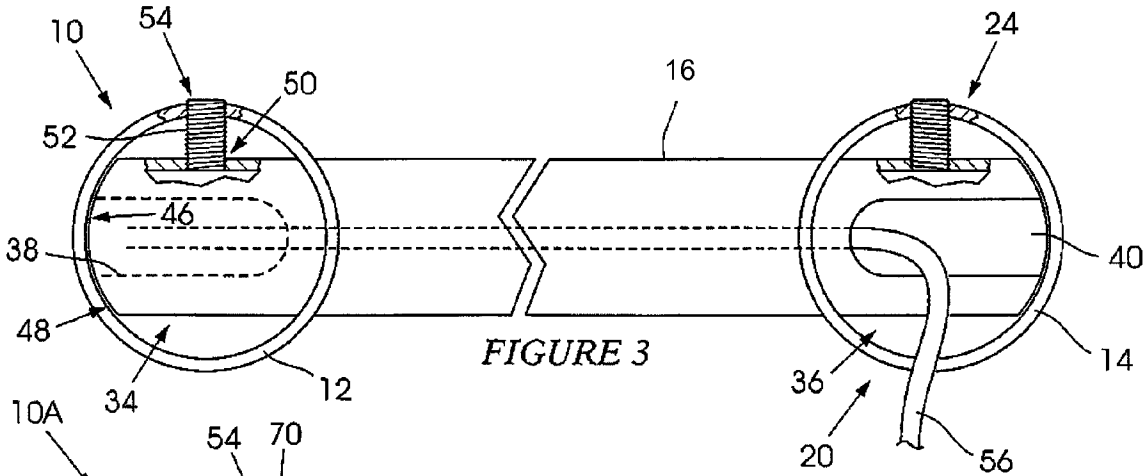
FIG. 3 is a partial, cross-sectional view from above of the towel rail of FIG. 1.

FIGS. 1, 2 and 3 illustrate a towel rail 10 which has a first vertically extending, elongate, tubular support 12, a second vertically extending, elongate, tubular support 14 which is spaced from the first support 12 and which opposes the first support 12, a plurality of horizontally extending, elongate, tubular cross beams 16, each of which extends from and between the first and second supports 12, 14 and four attachment or mounting brackets 18, each of which is interconnected with one of the first or second supports 12, 14.

The towel rail 10 has a front side 20 which faces away from a wall or fixed structure 22 to which the towel rail 10 is fixed by way of the brackets 18. The brackets 18 extend from a rear side 24 of the towel rail 10 which is opposite from the front side 20.

The supports 12, 14, beams 16 and brackets 18 are made from any appropriate metal such as stainless steel.

In this example the supports 12, 14 and beams 16 are circular in cross-section.

Each of the supports 12, 14 extend from an underside 26 to an upper side 28 and is sealed at its respective ends. Each support 12, 14 has a plurality of holes 30 formed therein. The number of holes 30 correspond with the number of beams 16 and are formed in a side of the supports 12, 14 between the front side 20 and the rear side 24. The respective holes 30 in the first support 12 face towards the respective holes 30 in the second support 14. Each hole 30 is dimensioned so that a beam 16 fits snugly therethrough.

The beams 16 are spaced apart in any appropriate configuration between the supports 12, 14 and lie one on top of the other from the underside 26 to the upper side 28.

Each beam 16 extends between a first end 34 and a second, opposing end 36. As is evident from FIGS. 2 and 3 the first end 34 extends into the first support 12 and the second end 36 extends into the second support 14.

The beam 16 has a first opening 38 formed in the first end 34 and a second opening 40 which is formed in the second end 36. Each of the first and second openings 38, 40 is in the form of a slot.

The first opening 38 faces in a first direction 42 and the second opening 40 faces in a second direction 44 which is opposite to the first direction 42. The direction of the first and second directions 42, 44 alternate between adjacent beams 16.

Each of the first and second ends 34, 36 has a leading abutment surface 46 which abuts a respective inner surface 48 of the respective support 12, 14.

The abutment surface 46 is complimentary in shape to the shape of the inner surface 48. In this example the abutment surface 46 is semicircular in order for the first end 34 to lie flush against the inner surface 48.

As is shown in FIG. 3 each of the first and second ends 34, 36 has a recess 50 formed therein with which a fastener 52 is engageable. Each recess 50 is in the form of a hole which extends through the beam 16. Importantly the recess 50 faces towards the rear side 24 of the towel rail 10.

The fastener 52 is in the form of a grub screw which extends through an aperture 54 in the respective supports 12, 14. Each aperture 54 faces towards the rear side 24. In use the positioning of the aperture 54 hides the aperture 54 and grub screw 52 from view.

An elongate, flexible electrical heating element 56 is at least partially threaded through the first and second supports 12, 14 and the beams 16. A cable connector 58 which is connected to the element 56 extends from the underside 26 of the first support 12 and enters the wall 22 where it is connected to electricity supply 60.

In use the towel rail 10 is fixed to the wall 22 by way of the brackets 18 in a known manner and, depending on requirements electrical supply 60 is connected to the element 56. The element 56 heats the supports 12, 14 and the beams 16 and the towel rail 10 acts as a radiator for the heating of a room and the drying and heating of, for example, a towel 62 which is draped over the beams 16.

The towel rail 10 is manufactured by cutting appropriate lengths of supports 12, 14 whereafter the opposing ends of each support 12, 14 are plugged and sealed. The appropriately spaced holes 30 are cut in each support 12, 14 and the apertures 54 are formed in the supports 12, 14. Appropriate lengths of beams 16 are cut whereafter the respective ends 34, 36 of each beam 16 is appropriately shaped to form the abutment surface 46. The openings 38, 40 and the recesses 50 are also formed in the respective first and second ends 34, 36. The supports 12, 14 and beams 16 are cut, shaped and formed by way of a laser cutter.

The towel rail 10 is assembled by passing the respective first and second ends 34, 36 of each beam 16 through opposing holes 30 in the first and second supports 12, 14. The abutment surface 46 of each end 34, 36 is brought into abutment with each respective inner surface 48 whereafter the screw 52 is screwed through the aperture 54 and into engagement with the recess 50 in order for the screw 52 to interconnect and fix the beam 16 to the respective support 12, 14.

The element 56 is threaded through the supports 12, 14 and beams 16 as they are assembled.

The positioning of the recesses 50 is important as this ensures that the beam 16 is fitted between the first and second supports 12, 14 with the opposing first and second openings 38, 40 facing the correct direction. As is shown in FIG. 2 the opposing openings 38, 40 of adjacent beams 16 in each support 12, 14 face opposite directions. This is important as a course is in this manner formed through the supports 12, 14 and beams 16 where through the element 56 extends.

The brackets 18 are attached to the respective first and second supports 12, 14 in a known manner and fixed to the wall 22 in a known manner.

The connector 58 is connected to the electricity supply 60 whereafter the towel rail 10 is ready for use.

No welding is required to fix the beams 16 to the supports 12, 14 and the towel rail 10 has a neat and aesthetically pleasing finish. The apertures 54 and screws 52 face towards the rear side 24 and are not visible in use.

The complimentary shape between the abutment surface 46 and the inner surface 48 provides stability to the towel rail 10 and the openings 38, 40 allow the element 56 to pass freely though the course defined by the supports 12, 14 and the beams 16.

As the towel rail 10 has a plurality of spaced apart beams 16 which interconnects the first and second supports 12, 14 a robust and stable structure is formed although only a single screw 52 is used to fix each end 34, 36 of each beam 16 to a respective support 12, 14.

Although two, spaced apart and opposing supports 12, 14 are used in this example it is possible to use a single support 12 in the construction of the towel rail 10. In this case each beam 16 is U-shaped and both the first and second ends 34, 36 of each beam 16 is fixed to the support 12 in the manner described.

Figure 4:
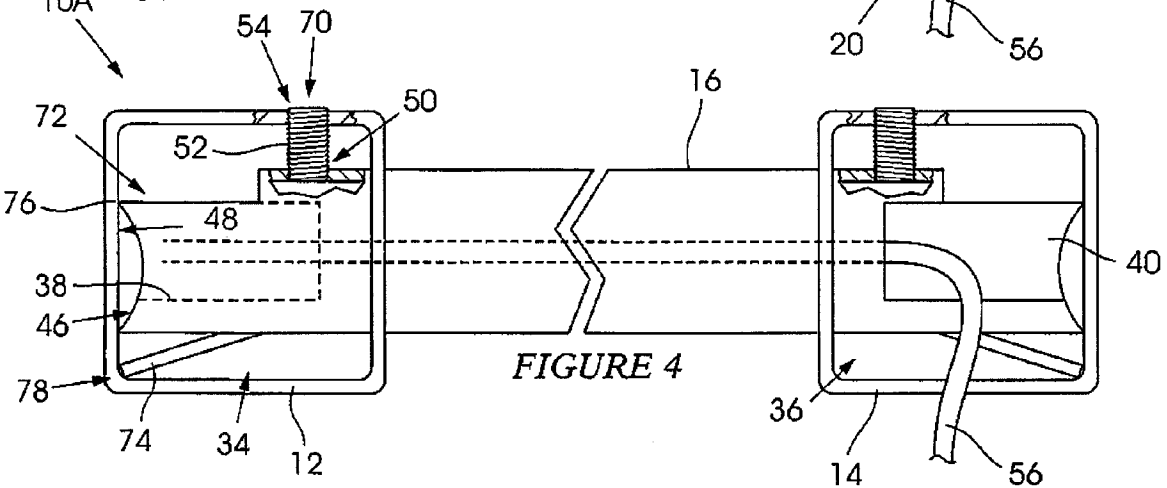
FIG. 4 is a partial, cross-sectional view from above of an alternative towel rail according to the invention.

FIG. 4 illustrates an alternative towel rail 10A. Similar reference numerals are used for components of the towel rail 10A which are described in respect of the towel rail 10 and only the differences between the towel rail 10A and the towel rail 10 are described.

The supports 12, 14 and beams 16 are rectangularly shaped in cross-section. The apertures 54 in the respective supports 12, 14 are formed in each support 12, 14 at a position 70 which is off-centre on the rear side 24 of the relevant support 12, 14.

Each of the first and second ends 34, 36 of each beam 16 has a stepped cut-away or shoulder 72 which faces the rear side 24. A spacer 74 is formed on each of the first and second ends 34, 36 and opposes the shoulder 72. The spacer 74 is integrally formed with the beam 16 and extends away from the respective first and second ends 34, 36. Each abutment surface 46 has two spaced apart contact points 76 which abut against the inner surface 48 of the respective support 12, 14.

The recess 50 in each end 34, 36 is positioned to align with the respective aperture 54 in the respective support 12, 14.

Each hole 30 is square-shaped to accommodate the respective beam 16.

In order to attach the respective ends 34, 36 to the respective supports 12, 14 each end 34, 36 is inserted into a hole 30 by passing the abutment surface 44 and spacer 74 through the hole 30. The shoulder 72 allows the spacer 74 to pass through the hole 30 and when the shoulder 72 comes into contact with the respective support 12, 14 the end 34, 36 is realigned with the hole 30 in order for the end 34, 36 to pass through the hole 30 and for the contact points 76 to come into abutment with the inner surface 48. The spacer 74 is brought into register with an inner corner 78 of the support 12, 14. Once the screw 52 interconnects the beam 16 with the support 12, 14 the end 34, 36 is stable inside the support 12, 14 as the end 34, 36 is trapped inside the support 12, 14 as a result of the screw 52 and the various areas of contact between the beam 16 and support 12, 14 at the hole 30, the spacer 74 and corner 78, and the contact points 76 and the inner surface 48.

The towel rail 10A is manufactured, assembled and used in a similar manner as the towel rail 10.

Figure 5:
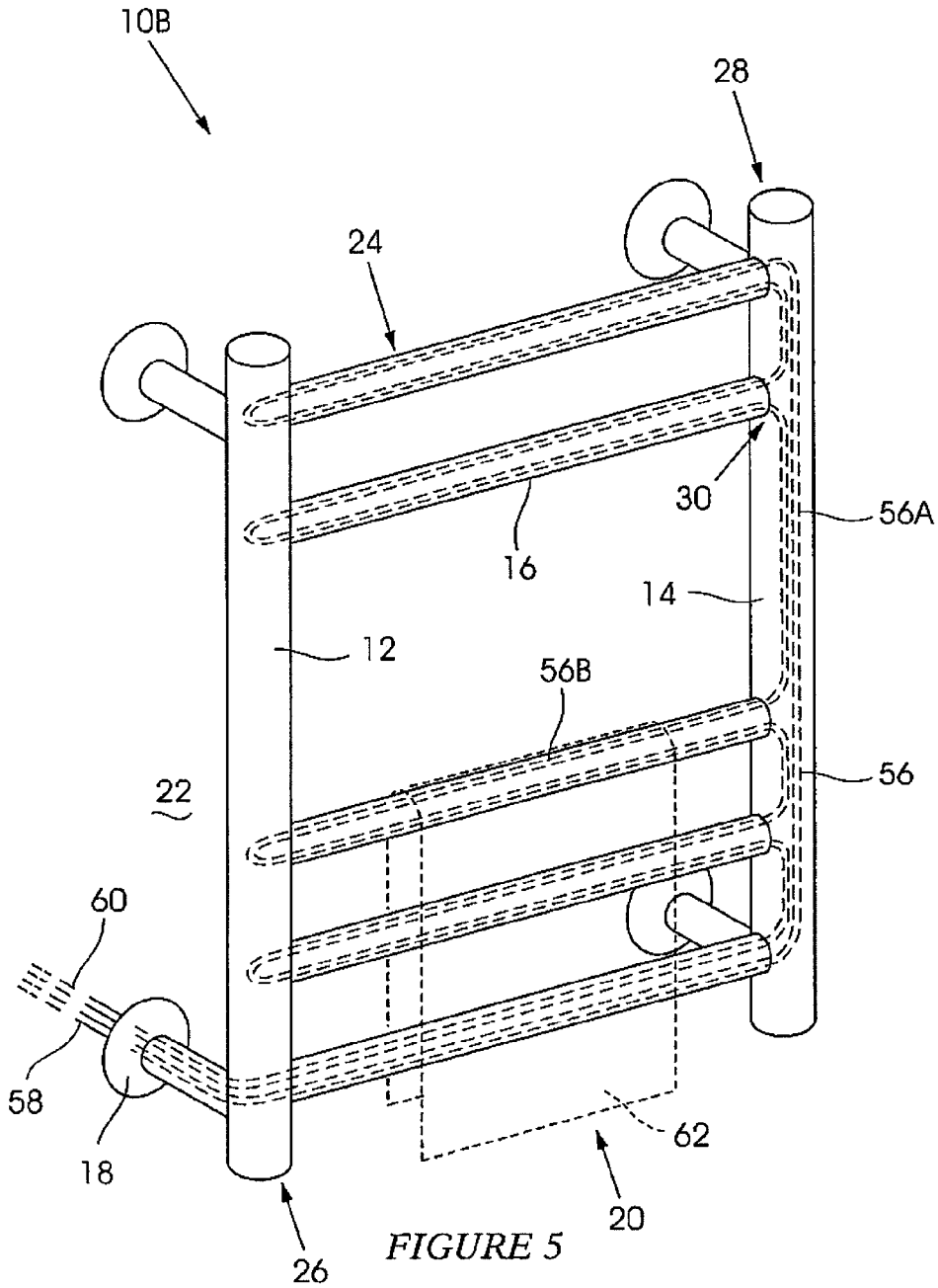
FIG. 5 is a perspective view of another towel rail according to the invention.
Figure 6:
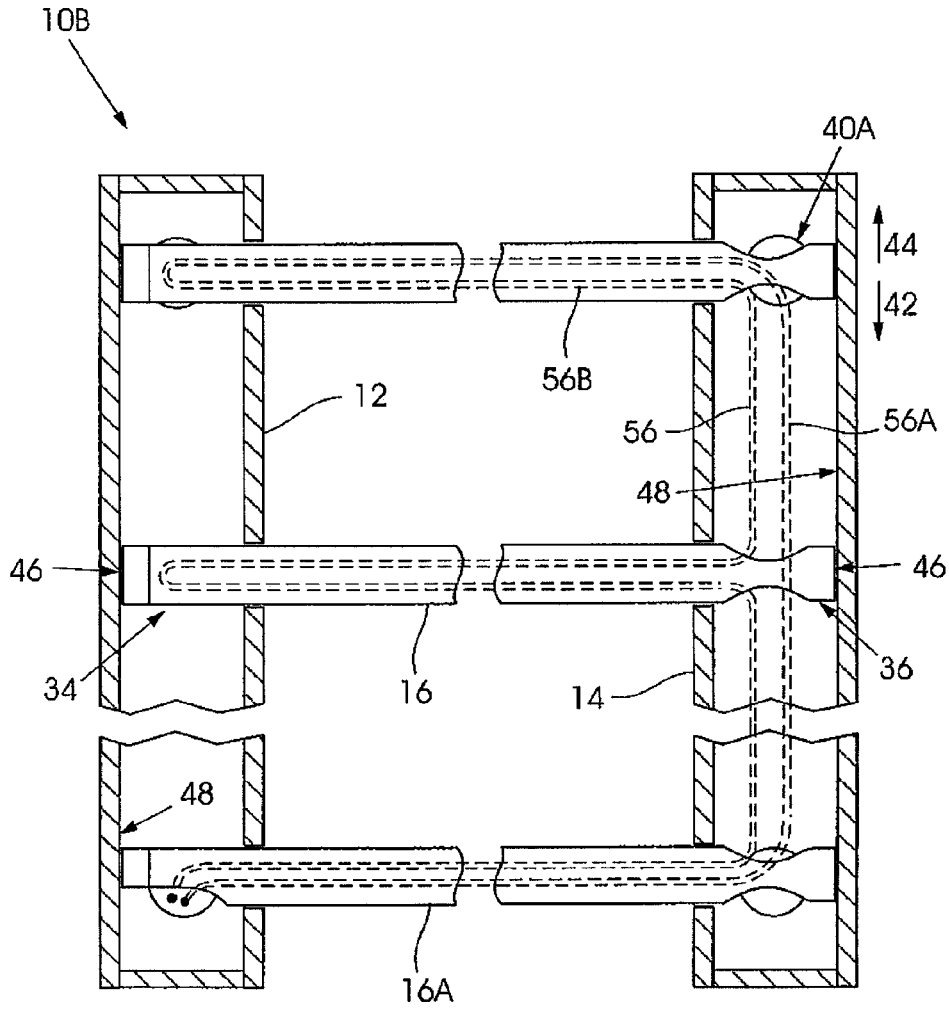
FIG. 6 is a partial, cross-sectional side view of the towel rail of FIG. 5.
Figure 7:
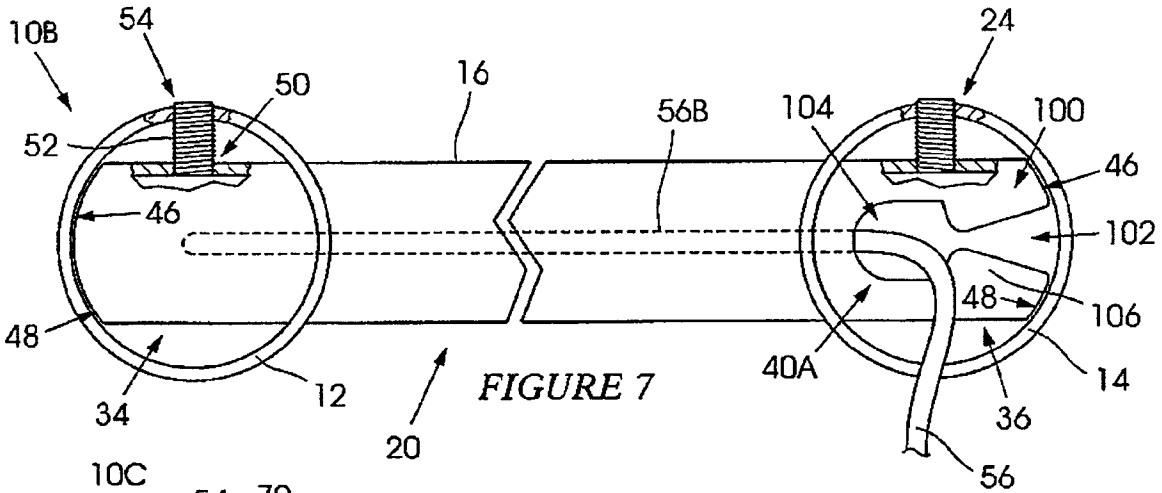
FIG. 7 is a partial, cross-sectional view from above of the towel rail of FIG. 5.

FIGS. 5, 6 and 7 show another towel rail 10B. Similar reference numerals are used for components of the towel rail 10B which are used and described in respect of the towel rails 10 and 10A and only the differences between the towel rails 10 and 10A and the towel rail 10B are described.

In the towel rail 10B the element 56 is not threaded through the supports 12, 14 and beams 16 in a zigzag pattern but extends through the lowermost beam 16A and the second support 14 from where it loops into each of the remaining beams 16.

This configuration assists in the assembly of the towel rail 10B. In the towel rail 10B the first opening 38 is omitted from each of the first ends 34 of all the beams 16 except that of the lowermost beam 16A.

The second opening 40A in each of the second ends 36 of the beams 16 is in the form of a U-shaped slot in plan which is open towards the abutment surface 46 of the second end 36 as well as into both the first direction 42 and the second direction 44. The element 56 passes through the second opening 40A in order to enter and exit each beam 16. A return section 56A of the element 56 also extends through some of the openings 40A.

As is illustrated in FIG. 7 each of the openings 40A has a catch formation 100 which separates the opening 40A into a mouth 102 and a channel 104 where through the element 56 extends. The catch formation 100 has a reducing taper from the mouth 102 towards the channel 104 and has opposing barbs 106 to restrict movement of the element 56 out of the channel 104.

During assembly of the towel rail 10B the element 56 is threaded through the second support 40 and appropriate lengths of the element 56 are looped through each hole 30. Each looped section 56B is threaded through a beam 16 with the element 56 extending from the second end 36. The second end 36 is inserted through the hole 30 and the element 56 is pulled through the mouth 102 and past the catch formation 100 in order for it to be located in the channel 104. The abutment surface 46 is brought into contact with the inner surface 48 and the fastener 52 is used to lock the beam 16 to the second support 14 in the manner described. The towel rail 10B is in all other respects manufactured and used in the same manner as the towel rails 10 and 10A.

The catch formation 100 prevents the element 56 from becoming tangled on the second end 36 and becoming trapped between the abutment surface 46 and the inner surface 48. As the opening 40A is open in both the first and second directions 42, 44 the element 56 can enter, exit and extend through the channel 104 in both directions.

Figure 8:
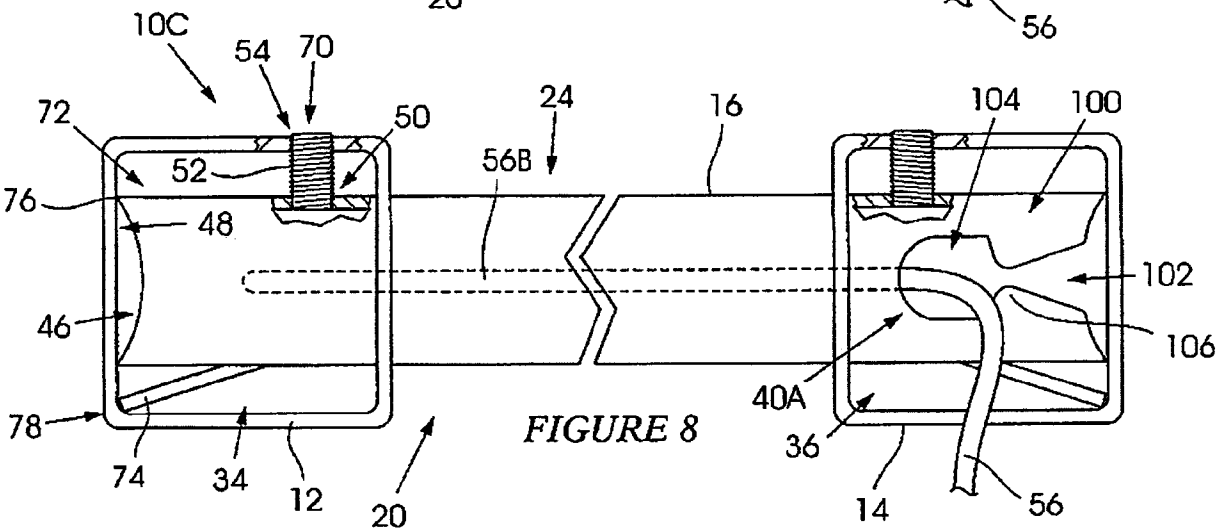
FIG. 8 is a partial, cross-sectional view from above of a further towel rail according to the invention.

FIG. 8 shows a towel rail 10C which is an alternative version of the towel rail 10A and which has features which are similar to those of the towel rail 10B. Similar reference numerals are used for components of the towel rail 10C which are used and described in respect of the towel rails 10, 10A and 10B.

The towel rail 10C is constructed and used in the same manner as the towel rails 10A, 10B.

Figure 10:
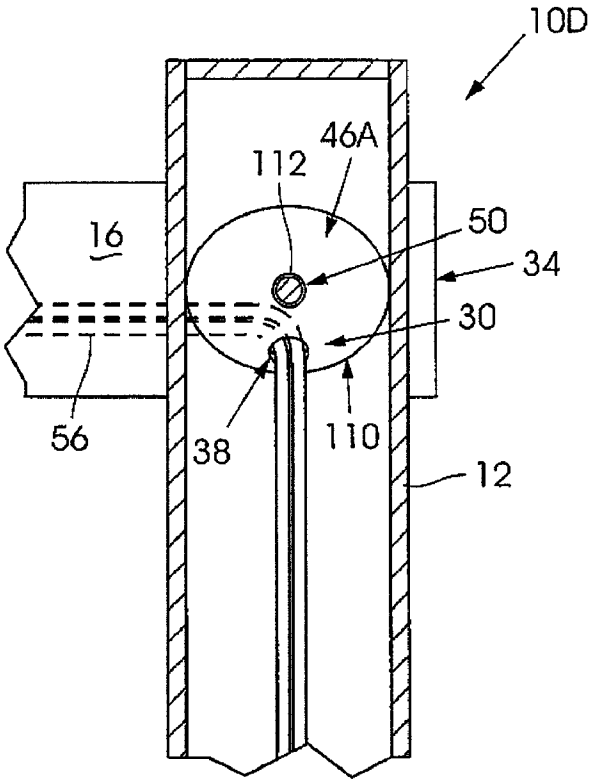
FIG. 10 is a partial, cross-sectional side view of the towel rail of FIG. 9.
Figure 9:
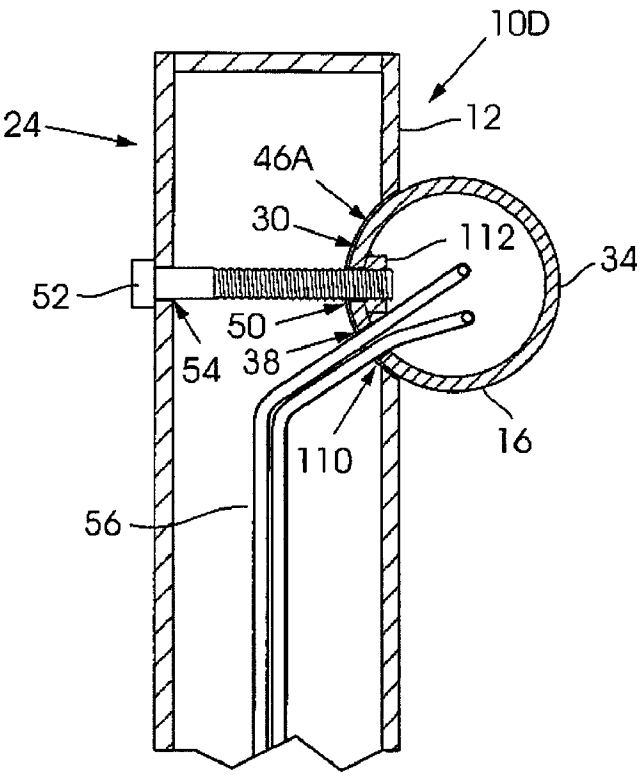
FIG. 9 is a partial, cross-sectional side view of yet another towel rail according to the invention.

FIGS. 9 and 10 illustrate another towel rail 10D. Similar reference numerals are used for components of the towel rail 10D which are used and described in respect of the towel rails 10, 10A, 10B and 10C and only the differences between the towel rail 10D and the towel rails 10, 10A, 10B, 10C are described.

In the towel rail 10D the first and second ends 34, 36 of the beams 16 do not extend into the supports 12, 14 but is engaged with, lie on top of and abut against the supports 12, 14. In the towel rail 10D the holes 30 have a general oval shape to define a seat surface 110 against which a semicircular, outer abutment surface 46A of the beam 16 abuts. The seat surface 110 and the abutment surface 46A are complementary shaped and the beam 16 fits snugly against the post 12, 14.

The recess 50 is fitted with a nut 112 and the fastener 52 is in the form of a bolt which extends through the aperture 54 and is threaded into the nut 112. In this manner the beam 16 is drawn towards the support 12, 14, is trapped in the hole 30 and is held against the support 12, 14. In the towel rail 10D the openings 38, 40 are in the form of holes which are in register with the respective hole 30. The exact position and shape of each opening 38, 40 can vary. The element 56 is threaded through the openings 38, 40 in the manner described.

The tower rail 10D is in other respects manufactured and used in the same manner as the towel rails 10A, 10B, 10C.

Figure 11:
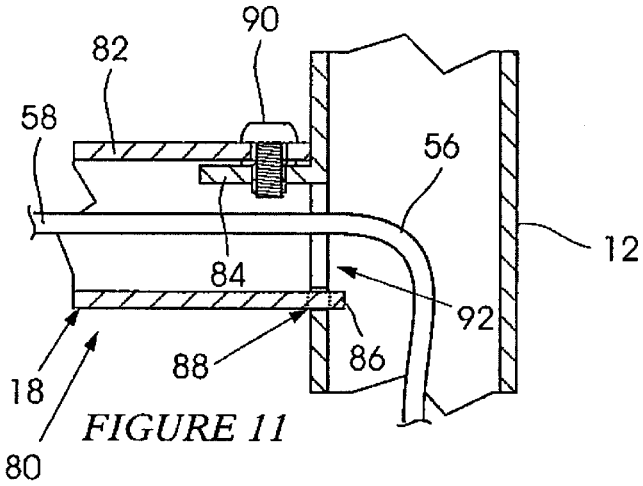
FIG. 11 is a partial, cross-sectional side view of a bracket connection used in the towel rail of FIG. 4.
Figure 12:
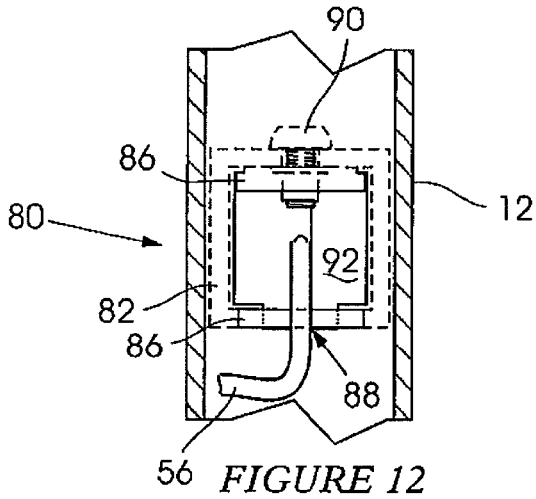
FIG. 12 is a partial, cross-sectional side view of the connection of FIG. 11.
Figure 13:
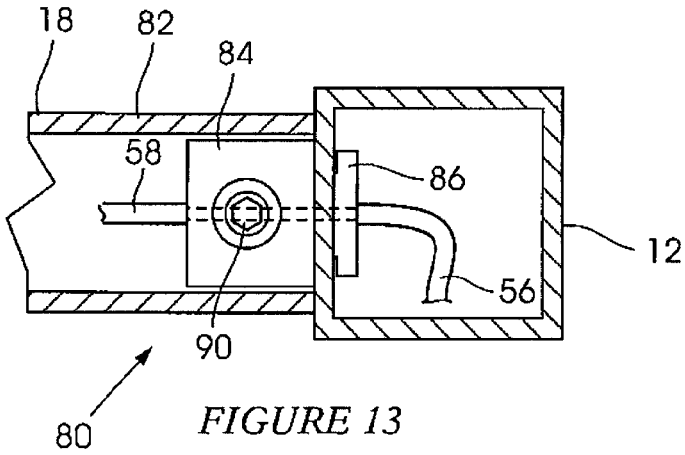
FIG. 13 is a partial, cross-sectional view from above of the connection of FIG. 11.

FIGS. 11, 12 and 13 illustrate the connection of a bracket 18 with a support 12 of the towel rail 10A. The bracket 18 is fixed to the support 12 by way of a connection 80. The connection 80 has a tubular arm 82 which is attached to and extends from the bracket 18 and a flange 84 which extends away from and which is integrally formed with the support 12. The arm 82 has a hook 86 at its leading end and a recessed catch 88 is formed in the support 12. The hook 86 is interengaged with the catch 88 in order for the arm 82 to lie flush against the support 12. The flange 84 extends at least partially into the arm 82 and a securing member or screw 90 passes through the arm 82 and flange 84 in order to interconnect and fix the arm 82 to the flange 84. The arm 82 is thus interconnected with the support 12 at the hook 86 and catch 88 and at the flange 84 which opposes the hook 86 and catch 88.

A passage 92 is formed from the support 12 through the connection 80 and to the bracket 18. This allows the connector 58 to extend the support 12, through the connection 80 and bracket 18 and into the wall 22 without being exposed to damage.

The connection 80 is formed by cutting the hook 86 from the arm 82 and by simultaneously cutting the flange 84 and the catch 88 in from the support 12. The flange 84 is bent away from the support 12 in order for the flange 84 to extend at a right angle from the support 12. Appropriate apertures 94 are formed in the arm 82 and flange 84 in order for the screw 90 to pass therethrough.

The connection 80 ensures that the arm 82 lies flush against the support 12 and the flange 84 and screw 90 forces the hook 86 into firm and permanent interengagement with the catch 88. In this manner the arm 82 is fixed to the support 12 at the flange 84 and the catch 88.

Importantly the flange 84, catch 88 and passage 92 are surrounded by the arm 82 and are hidden from view.

The connection 80 allows the bracket 18 to be fixed to the support 12 without the need for welding and ensures a neat and aesthetically pleasing finish. Additionally the connector 58 can be hidden from view and damage.

The connection 80 can be used at all the brackets 18 or can alternatively be used at at least one of the brackets 18.

By appropriately shaping the leading end of the arm 82 and the flange 84 the connection 80 can also be used in respect of circular supports 12, 14 such as those used in the towel rails 10, 10B, 10D.

The invention claimed is:

1. A method of assembling a towel rail having i) first and second vertically extending, elongate, tubular supports which oppose and are spaced apart from each other, ii) a plurality of spaced apart, horizontally extending, tubular beams, each having a first end with a first fastener and an opposing second end with a second fastener and iii) a plurality of holes formed in a side of each of the first and second supports, through which holes each first end of each beam extends into the first support and each second end of each beam extends into the second support, the method comprising the steps of:

(a) threading an elongate flexible heating element through the first support;

(b) looping an appropriate length of the heating element through each hole of the first support to form a looped section associated with and extending out from each hole of the first support, thereby forming plural looped sections;

(c) threading each looped section through a respective one of the beams from the first end of the respective beams;

(d) inserting the second end of each of the beams through a respective one of the holes of the second support to bring an abutment surface of the second end of each beam into contact with an inner surface of the second support; and (e) locking the second end of the beams to the second support by passing the second fastener of each beam through the second support to engage with a recess of the second end of its respective beam.

2. A method according to claim 1, further comprising the step of inserting the first end of each of the beams through a respective one of the holes of the first support to bring an abutment surface of the first end of each beam into contact with an inner surface of the first support.

3. A method according to claim 2, further comprising the step of locking the first end of each beam to the first support by passing the first fastener of each beam at least partially through the first support to engage with a recess of the first end of its respective beam.

4. A method according to claim 2, wherein the abutment surface of the first end and the second end of each beam, is complementary in shape to the respective inner surface of the first and second supports.

5. A method according to claim 3, wherein the abutment surface of the first end and the second end of each beam, is complementary in shape to the respective inner surface of the first and second supports.

6. A method according to claim 1, wherein each beam includes, at the first end, a pair of opposed slotted openings comprised of one opening facing a first direction and one opening facing a second direction.

7. A method according to claim 2, wherein each beam includes, at the first end, a pair of opposed slotted openings comprised of one opening facing a first direction and one opening facing a second direction.

8. A method according to claim 3, wherein each beam includes, at the first end, a pair of opposed slotted openings comprised of one opening facing a first direction and one opening facing a second direction.

9. A method according to claim 4, wherein each beam includes, at the first end, a pair of opposed slotted openings comprised of one opening facing a first direction and one opening facing a second direction.

10. A method according to claim 5, wherein each beam includes, at the first end, a pair of opposed slotted openings comprised of one opening facing a first direction and one opening facing a second direction.

11. A method according to claim 6, wherein each slotted opening has a mouth, a channel and a catch formation separating the mouth from the channel.

12. A method according to claim 11, wherein the catch formation has a reducing taper from the mouth towards the channel.

13. A method according to claim 11, further comprising the step, after said inserting step (d), of pulling the heating element through the mouth of each opening, past the catch formation, to hold the respective looped section of the heating element in place.

14. A method according to claim 12, further comprising the step, after said inserting step (d), of pulling the heating element through the mouth of each opening, past the catch formation, to hold the respective looped section of the heating element in place.

15. A method of assembling a towel rail having i) first and second vertically extending, elongate, tubular supports which oppose and are spaced apart from each other, ii) a plurality of spaced apart, horizontally extending, tubular beams, each having a first end and an opposing second end, and iii) a plurality of holes formed in a side of each of the first and second supports, through which holes each first end of each beam extends into the first support and each second end of each beam extends into the second support, the method comprising the steps of:

(a) threading an elongate flexible electrical heating element through one of the supports;

(b) looping an appropriate length of the heating element through each hole of the one support to form a looped section associated with and extending out from each hole of the one support, thereby forming plural looped sections;

(c) threading each looped section through a respective one of the beams so that an end portion of each loop extends towards the other, opposing support;

(d) inserting each of the beams through a respective one of the holes of a selected one of the supports to bring an end abutment surface of each beam into contact with an inner surface of the selected one of the supports; and (e) locking the ends of the beams with the abutment surface contacting the inner surface of the selected one of the supports by i) passing fasteners at least partially through the selected one of the supports, and ii) engaging the fasteners with the ends of the beams with the abutment surface contacting the inner surface of the selected one of the supports.

16. A method according to claim 15, further comprising the step of inserting each of the beams through respective holes of the other, opposing support to bring another end abutment surface of each beam into contact with an inner surface of the other, opposing support.

17. A method according to claim 16, further comprising passing further fasteners at least partially through the other, opposing support to engage the further fasteners with the ends of the beams with the another end abutment surface.

18. A method according to claim 15, wherein each beam includes, at the second end, a pair of opposed slotted openings comprised of one opening facing a first direction and one opening facing a second direction.

19. A method according to claim 18, wherein each slotted opening has a mouth, a channel and a catch formation separating the mouth from the channel.

20. A method according to claim 19, wherein the catch formation has a reducing taper from the mouth towards the channel, and further comprising the step, after said inserting step (d), of pulling the heating element through the mouth of each opening, past the catch formation, to hold the respective looped section of the heating element in place.

* * * * *